US007286050B2

(12) United States Patent
Faltesek

(10) Patent No.: US 7,286,050 B2
(45) Date of Patent: Oct. 23, 2007

(54) FIRE LOCATION DETECTION AND ESTIMATION OF FIRE SPREAD THROUGH IMAGE PROCESSING BASED ANALYSIS OF DETECTOR ACTIVATION

(75) Inventor: Anthony E. Faltesek, Roseville, MN (US)

(73) Assignee: Honeywell International, Inc., Morristown, NJ (US)

( * ) Notice: Subject to any disclaimer, the term of this patent is extended or adjusted under 35 U.S.C. 154(b) by 585 days.

(21) Appl. No.: 10/728,704

(22) Filed: Dec. 5, 2003

(65) Prior Publication Data

US 2005/0128071 A1 Jun. 16, 2005

(51) Int. Cl.
*G08B 25/00* (2006.01)

(52) U.S. Cl. ..... 340/524; 340/525; 340/539.27; 340/825.36; 340/825.49

(58) Field of Classification Search ..... 340/524, 340/506, 525, 539.26, 539.27, 577, 825.36, 340/825.49, 286.05
See application file for complete search history.

(56) References Cited

U.S. PATENT DOCUMENTS 4,581,605 A 4/1986 Vogt
4,796,205 A * 1/1989 Ishii et al. ..... 340/506
5,726,633 A 3/1998 Wiemeyer
5,734,335 A * 3/1998 Brogi et al. ..... 340/870.05
5,764,142 A 6/1998 Anderson et al.
5,892,440 A * 4/1999 Bryan ..... 340/524
5,936,544 A 8/1999 Gonzales et al.
6,281,790 B1 * 8/2001 Kimmel et al. ..... 340/506
6,289,331 B1 * 9/2001 Pedersen et al. ..... 706/60
6,366,215 B1 4/2002 Tice et al.
6,369,695 B1 * 4/2002 Horon ..... 340/286.01
6,556,981 B2 * 4/2003 Pedersen et al. ..... 706/44
6,577,232 B1 6/2003 Hawkinson et al.
6,701,281 B2 * 3/2004 Satoh et al. ..... 702/182
6,885,303 B2 * 4/2005 Payton et al. ..... 340/565
7,012,517 B2 * 3/2006 Mueller et al. ..... 340/525

* cited by examiner

*Primary Examiner*—Daryl C Pope
(74) *Attorney, Agent, or Firm*—Welsh & Katz, Ltd.

(57) ABSTRACT

A system and a method of establishing direction and velocity of fire development in a region. A fire profile based on a time sequence of alarming detectors provides both direction and velocity information. Future directions of development can be estimated by analogizing fire progression to a ball bouncing off of a rigid wall.

8 Claims, 5 Drawing Sheets

FIRE LOCATION DETECTION AND ESTIMATION OF FIRE SPREAD THROUGH IMAGE PROCESSING BASED ANALYSIS OF DETECTOR ACTIVATION

FIELD OF THE INVENTION

The invention pertains to monitoring systems and methods such as fire detection systems and methods usable to monitor fire related conditions in a region. More particularly, the invention pertains to such systems and methods which incorporate fire progression information and displays to assist fire fighting personnel in evaluating and suppressing fire conditions in the region.

BACKGROUND OF THE INVENTION

Fires can be difficult to locate in buildings. Smoke obscures views, and buildings can be large and complicated. The effort needed to find the fire takes time away from the available time for fighting the fire. Most fire departments use a 20 minute rule.

If the fire is not at least well under control within 20 minutes from inception, then the building, or the portion of the building that this fire is in, is probably lost. Fire departments then shift to containment strategies to attempt to prevent the fire from spreading and taking more of the building.

It would be helpful to fire fighters to know how the fire is developing in the building when they arrive on the scene, or as quickly as possible thereafter. Understanding fire development can be difficult given the levels of detection in some existing buildings. Some areas in some buildings may have very few fire detectors. This scarcity of detectors is permitted by code depending on when the fire protection system was installed, as well as the configuration of spaces and fire walls.

There continues to be a need to better assess fire location and direction of fire development to assist fire fighting and rescue personnel. Preferably existing alarm systems could be upgraded to provide this additional functionality.

Numerous other advantages and features of the present invention will become readily apparent from the following detailed description of the invention and the embodiment thereof, from the claims and from the accompanying drawings.

BRIEF DESCRIPTION OF THE DRAWINGS

FIGS. 3-1, -2, -3 illustrate a first form of image processing in accordance with the invention;

FIGS. 4-1, -2 illustrate a second form of image processing in accordance with the invention; and FIGS. 5-1, -2 illustrate a third form of image processing in accordance with the invention.

DETAILED DESCRIPTION OF THE EMBODIMENTS

Figure 1:
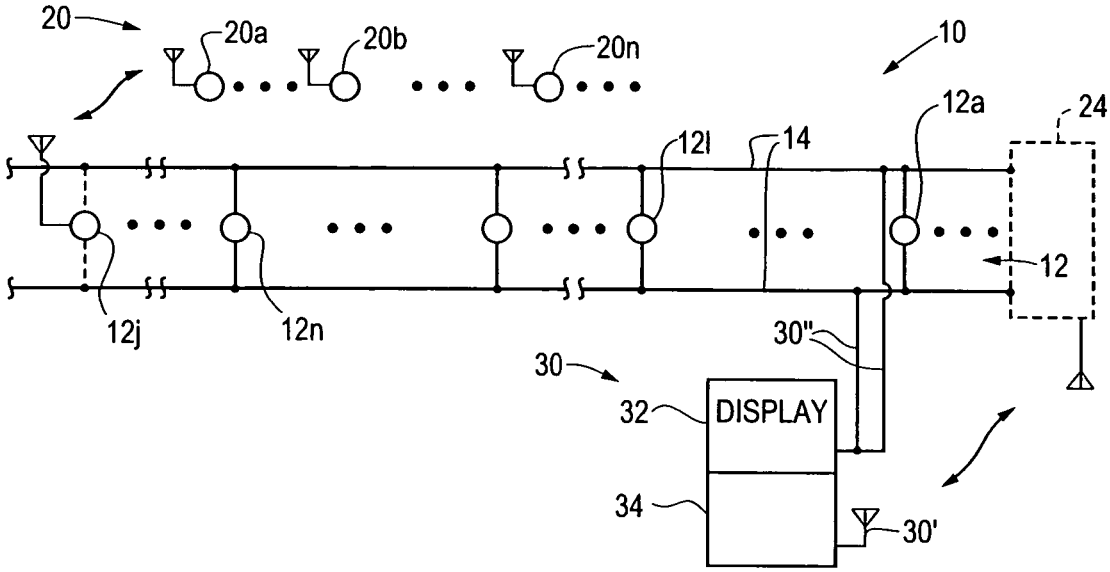
FIG. 1 is a block diagram of a monitoring system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

Image processing can be used in one embodiment of the invention to derive meaningful information about the locations of fires in buildings from available detector information. Floor plans of buildings are a graphic representation of the building. Specifically, floor plans are a representation of a building that has been sliced at about 5 feet above the floor level. Such representations can be shown using a downward looking point of view, a top plan view of the floor. This representation is an image. Smoke detectors can be placed in relation to this floor plan.

This type of plan is a hybrid created by superimposing parts of a reflected ceiling plan onto a floor plan. The combination is usually quickly and easily interpreted by viewers who see ceiling mounted detectors located on a floor plan. This combined plan is not only an image, but it can be pixelized and analyzed as described below.

In accordance with the invention, output signals from ambient condition detectors, such as smoke or thermal detectors, can be processed to more accurately determine the location of fire. Such outputs can be used to estimate the progress of the fire. At least some currently installed fire protection systems illustrate which smoke or heat detectors have gone into alarm on a floor plan on a display that is part of their user interface. This location information can be very useful. The sequence in which smoke or heat detectors go into alarm can be analyzed to provide insight into a developing fire.

There are some fire behaviors that tend to hold true in many different fires and types of fires. Fires tend to progress rather than backtrack; they do not usually go in one direction and then reverse direction.

Fires tend not to cross fire-proof barriers, at least when the barrier is working properly. Fires tend to be fairly continuous. They do not normally appear in highly separate locations in the horizontal plane. Fires may jump from floor to floor along a vertical plane, but rarely hop in a discontinuous way on the horizontal plane.

The sequence in which detectors alarm can be stored and related to the associated floor plan. The spacing and sequence of sensor activation can then be analyzed. A vector suggesting the direction of movement can be established by the advancing front of activating detectors. The general direction that the vector is pointing, can be used to identify area(s) at risk for at least filling with smoke, and possibly catching fire.

The speed or velocity of the vector is established by the speed of advancement of the activating front, of detectors. A vector can also be defined as showing the direction and momentum of activating detectors that are contiguous.

Another method determines where fire barriers are located in relation to this vector. In this analysis, fire will collide with a fire barrier the way a vector would collide with a fixed object.

The vector can be treated as if it will rebound off the barrier at angles similar to what would happen if a rolling ball struck the barrier. Although a fire would not ricochet off a wall, nevertheless, a fireproof wall will deflect the flame. Thus, a fire that is contained from the top will travel through a space and interact with objects like a vector.

Separate fires can be indicated by a reversal of vector direction. Vectors will not reverse direction under normal fire propagation. A reversal will usually indicate two different fire locations that are activating detectors in patterns that will look like reversals.

A method that could be used to determine whether there are separate fires in a building is based on determining whether there are sudden reversals in the direction of the vector. If a vector goes steadily in one direction, and suddenly jumps across detectors that have not alarmed, and then reverses direction to return to the original front of advancement, there are indications that there are separate fires. Vectors can be defined in terms of the direction and speed of advancement of contiguously alarming detectors. Hopping over non-alarming detectors indicates the possibility of two fires.

Several vector analysis techniques could be carried out with the data simultaneously. One could contribute to the analysis of how the fire front or fronts were propagating. Another could create a single vector from all alarms to check for backtracking or other indicia of separate fires.

Figure 2:
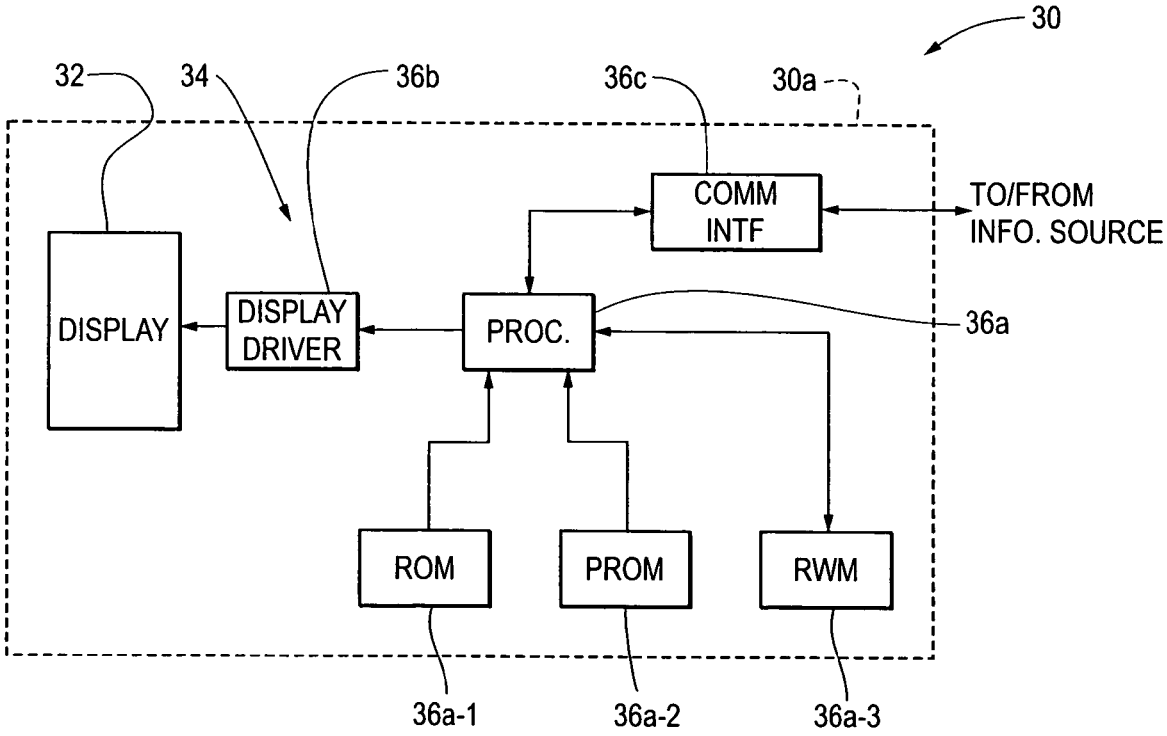
FIG. 2 is a block diagram of a control unit for the system of FIG. 1.

FIGS. 1, 2 illustrate details of a system that can implement one or more of the above described methods. In FIG. 1, a system 10 incorporates a plurality of electrical units 12, including 12*a*, 12*b* . . . 12*n*, all of which can be in bi-directional communication via a communications link 14. The link 14 could be implemented as a hard-wired electrical or optical cable. Alternately, as illustrated in connection with the system 10, a plurality 20 of electrical units 20*a*, 20*b* 20*n* could communicate with one another wirelessly.

Wireless communication could be implemented using RF signals or the like without limitation. The members of the plurality 20 could be in wireless communication with one or more members, such as the member 12*j* of the plurality 12. It will be understood that the exact details of communication between electrical units, members of the plurality 12 and 20, is not a limitation of the present invention.

If desired, the system 10 could include a common control element 24, illustrated in phantom, to provide sequencing, power and supervision for the electrical units in the pluralities 12 and 20.

The members of the pluralities 12 and 20 could include ambient condition detectors as well as audible or visible output devices without limitation. Types of detectors could include fire detectors, such as flame, thermal or smoke detectors. Other types of detectors could include motion detectors, position detectors, flow detectors, velocity detectors, and the like, all without limitation.

Coupled to the system 10, either via hardwiring or wirelessly is a display device 30. It will be understood that the device 30 could be implemented as a portion of the control element 24 if desired. Alternately, the device 30 could be a separate unit from the control element 24. Device 30 could also be a portable unit which is in wireless communication with the system 10.

Device 30 includes a display unit 32 and a processing section 34. A port or ports can be provided on device 30 to connect it to system 10 wirelessly, via antenna 30' or hardwired with cable 30".

With reference to FIG. 2, a case or housing 30*a* contains, carries or supports the display device 32 and the processing element 34. The processing element 34 in turn includes a programmable processor 36*a* which is in communication with local read-only member 36*a*-1 and/or local programmable read-only memory 36*a*-2 and/or local read/write memory 36*a*-3.

The associated local memory incorporates executable control instructions whereby the processor 36*a* carries out an analysis and display function as described subsequently. Additionally, information as described subsequently, can be stored in the device 30 on a real-time basis or downloaded from the system 10 for display.

The processor element 34 also includes display driver circuitry 36*b* and a bi-directional communications interface 36*c* intended to be used with antenna 30' for wireless communication or to be coupled via cable 30" to communication link 14.

It will be understood that the device 30 could be permanently attached to the system 10 and provide displays only associated therewith. Alternately, the device 30 could be a stand-alone device in wireless communication with a variety of ambient condition sensing systems without limitation.

Figures 1, 3:
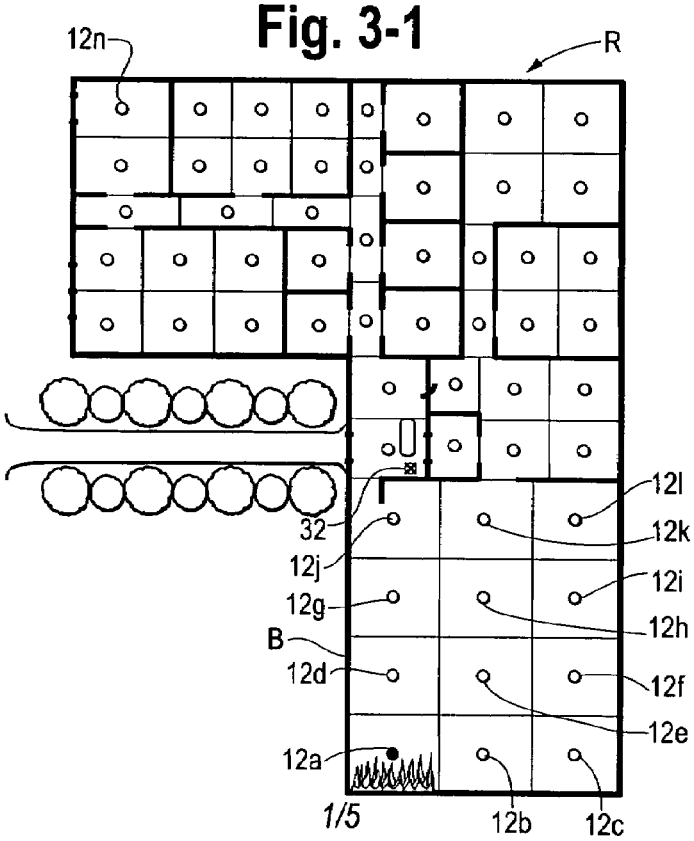
Figures 2, 3:
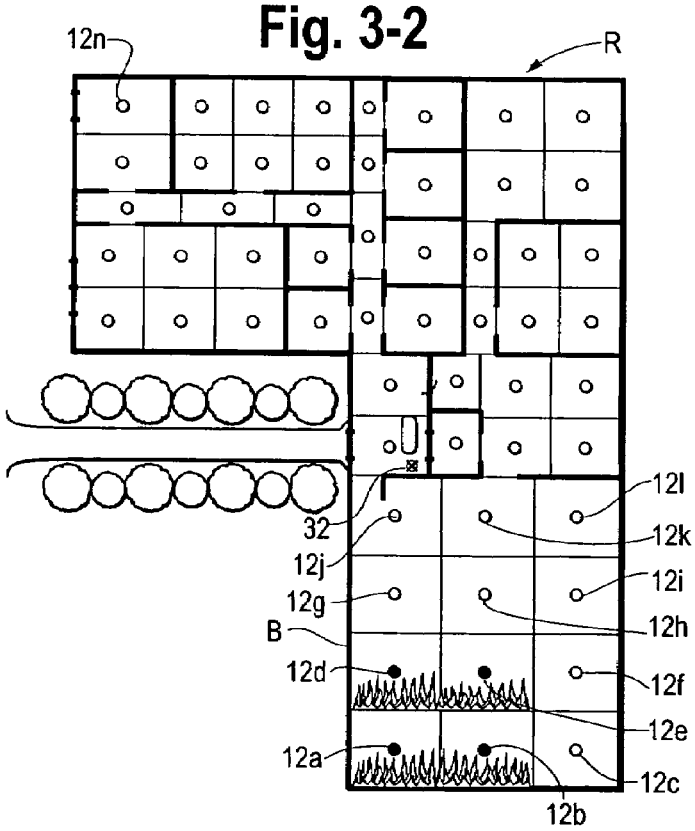
Figure 3:
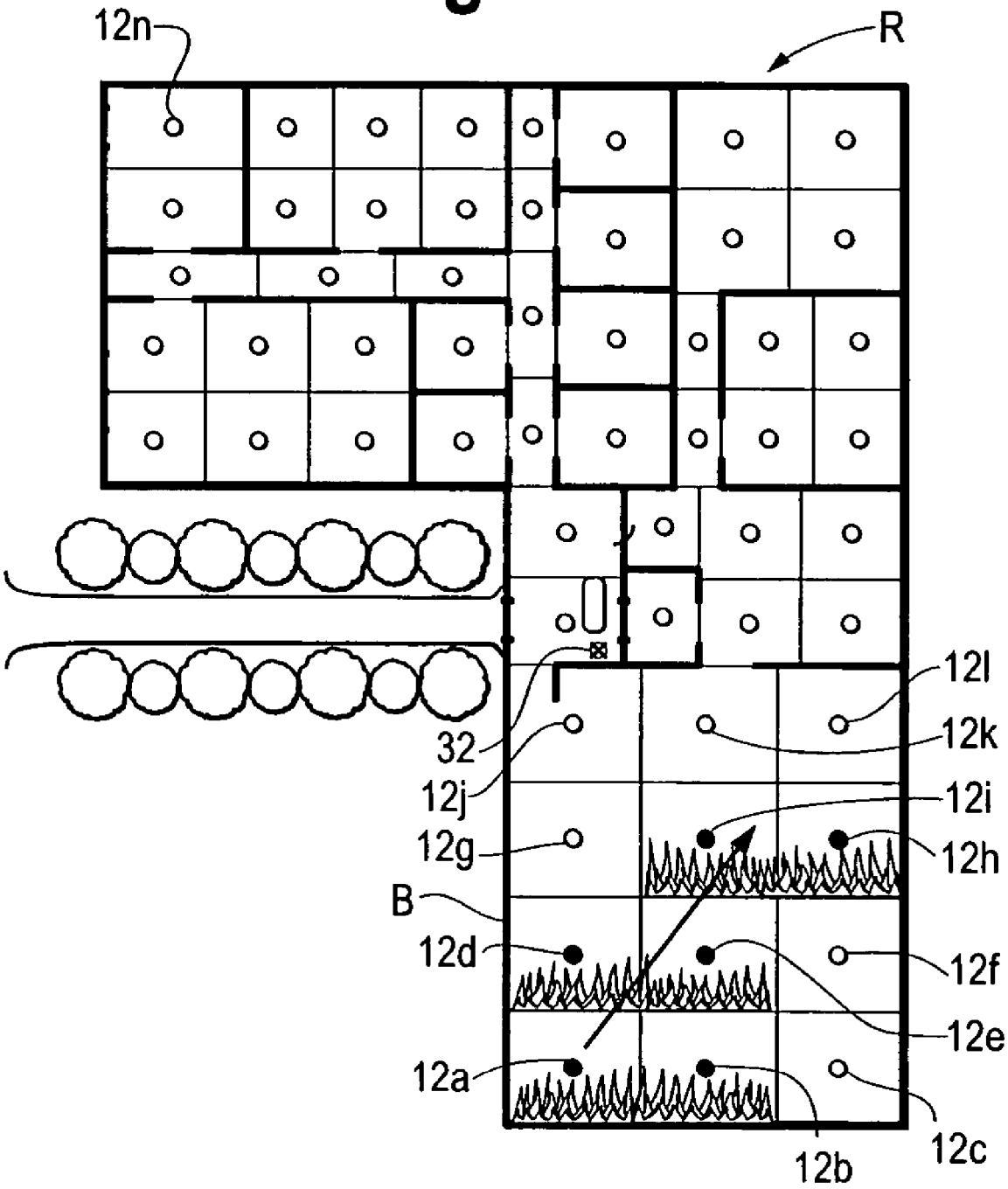

As illustrated in FIGS. 3-1, -2, -3, detectors 12*a* 12*n* are located throughout a region R. Region R could represent one floor of a multi-floor building B being monitored. For exemplary purposes only, FIGS. 3-1 through 3-3 illustrate a display unit 32 located at the region R. In this embodiment, display unit 32 would be in either wireless or hardwired communication with the system 10. Other locations are possible and come within the spirit and scope of the invention.

The system 10 includes the members of the plurality 12 which might be implemented as smoke detectors. The detectors 12 are illustrated installed throughout the region R. When so configured, the system 10 would function as a fire alarm system. In the event that the members of the plurality 12 included other types of sensors such as position or motion or motion sensors, the system 10 could also provide an intrusion monitoring function. It will also be understood that the members of the plurality 12 could each incorporate multiple sensors, for example, smoke, gas, thermal, without limitation and without departing from the spirit and scope of the present invention.

FIGS. 3-1 through 3-3 illustrate evolving fire conditions in the region R that are being monitored by the system 10.

In FIG. 3-1, a detector 12*a* has gone into alarm indicative of the presence of a local fire condition. Subsequently, FIG. 3-2, the fire has spread and detectors 12*a, b, d* and *e* have all gone into alarm. FIG. 3-3 illustrates further progression of the fire condition wherein detectors 12*h, i* have also gone into alarm.

In FIG. 3-3, enough information is present for the processor 36*a*, by executing pre-stored instructions or software, to project both developing fire direction, vector V, as well as both estimated velocity of the fire condition. Estimated velocity can be illustrated in FIG. 3-3 by providing vector V with a variable length. A higher velocity being indicated by a longer length. Alternately, vector V could carry a velocity indicator, for example, as shown in parentheses "High". It will be understood that a variety of indicia can be used to indicate a velocity, all within the spirit and scope of the present invention.

The graphical processing illustrated by FIGS. 3-1 . . . -3 can be viewed at display 32 at the entrance way to the building B, for example, to be readily available to first responders arriving at the scene. Knowing the direction of fire development, indicated by the direction of the vector V as well as the velocity, indicated by indicia associated therewith, can be useful and important to the fire fighting personnel arriving at the scene.

A variety of different processes can be carried out so as to develop the direction and magnitude information for graphical presentation. The details of such processing are not limitations of the invention.

Figures 1, 4:
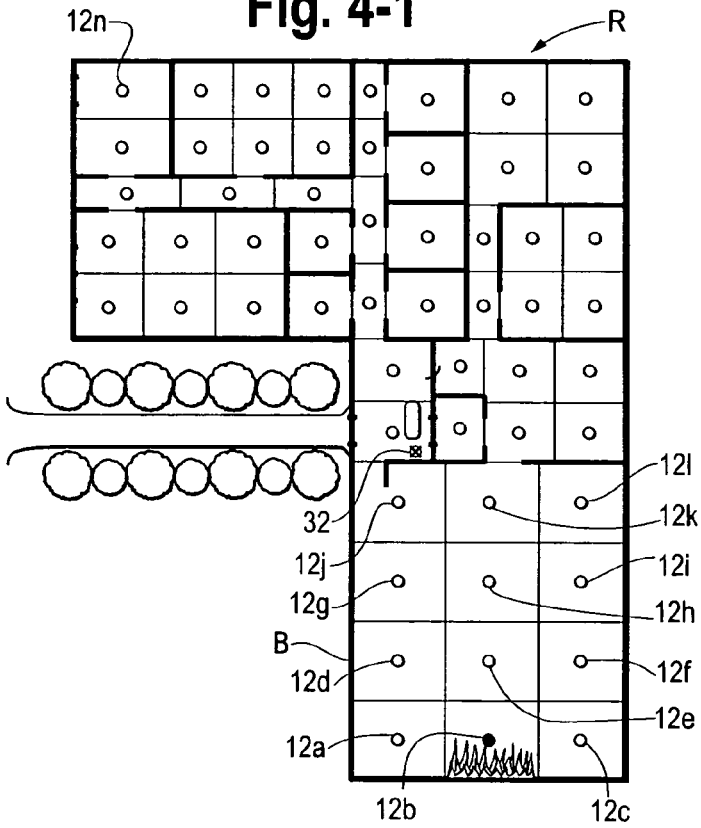
Figures 2, 4:
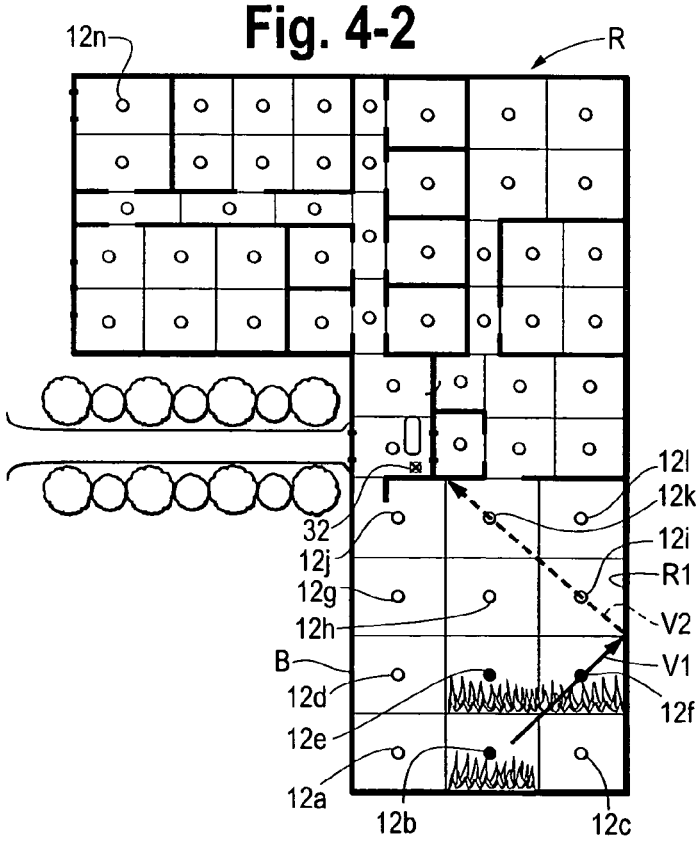

FIGS. 4-1 and 4-2 illustrate another form of processing which can be implemented, for example by processor 36*a*, without limitation. In FIG. 4-1 a detector 12*b* indicates an alarm condition. In FIG. 4-2, the fire development is progressed such that detectors 12*e* and 12*f* also indicate an alarm condition. Associated with the three active detectors is a vector V1 with a direction indicated to intersect fire resistant wall R1.

Processor 36*a*, using the information from FIGS. 4-1, -2, by executing pre-stored instructions or software, can estimate how the developing fire indicated by vector V1 will rebound off of fire resistant wall R1 as indicated by vector V2. This processing enables first responders to view the projection of vector V1 rebounding off of wall R1, as indicated by vector V2 thereby providing insight into potential future directions for fire development. It will be understood that the processing illustrated by FIGS. 4-1, 4-2 could be expanded to incorporate secondary effects such as frictional effects associated with fire resistant surface R1 and the like, all without limitation. Additionally, velocity information, as described above, could also be projected for vector V2 and displayed therewith.

Figures 1, 5:
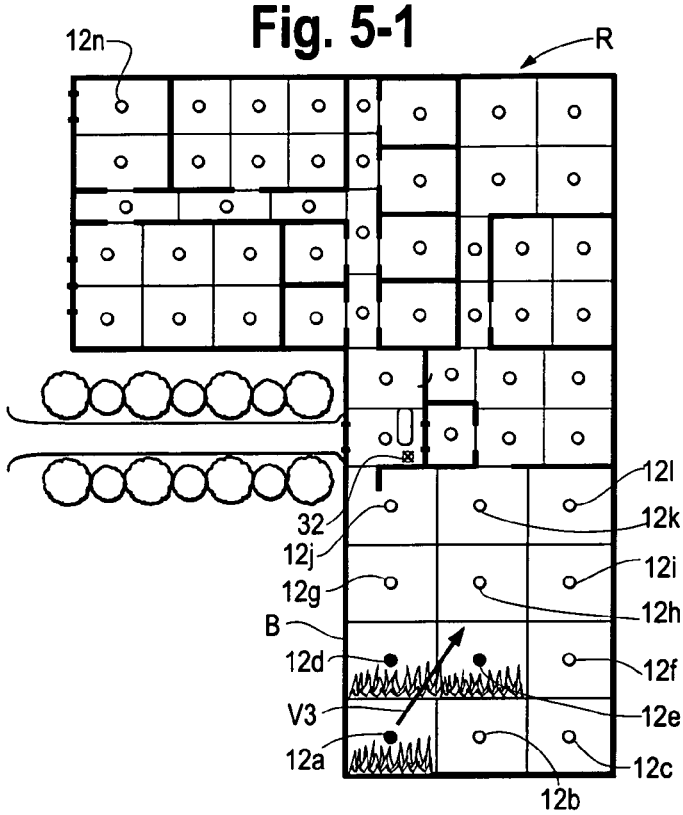
Figures 2, 5:
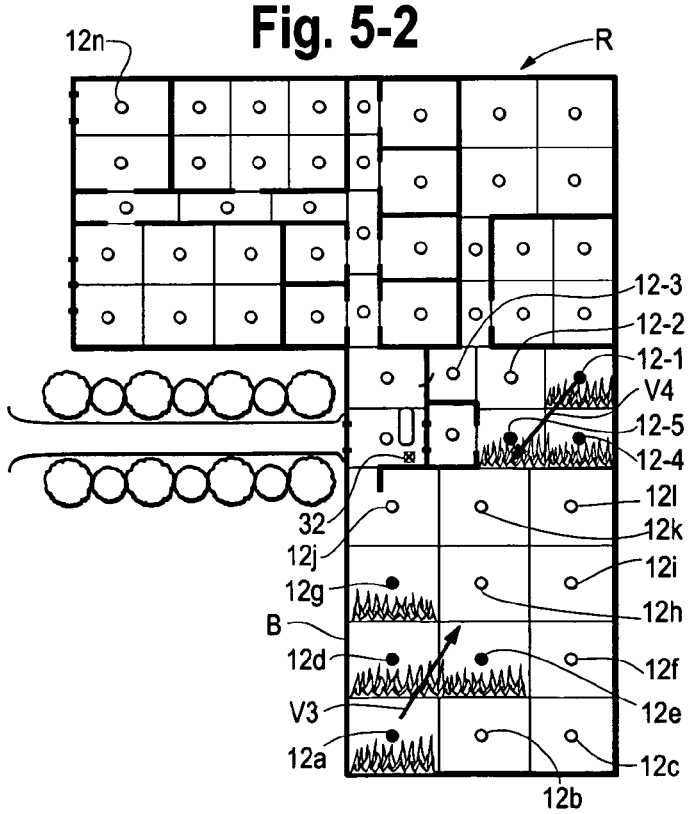

FIGS. 5-1, -2 illustrate image processing, by processor 36*a* using pre-stored software, where two separate fire conditions are developing in the region R. In FIG. 5-1, detectors 12*a*, 12*d* and 12*e* have gone into alarm. The image processing has generated vector V3 indicative of direction of fire development.

In FIG. 5-2, detector 12*g* has also gone into alarm as the initial fire condition has continued to spread and its direction of development is indicated by vector V3'. Further, in FIG. 5-2 a second fire condition has developed. Responsive thereto detectors 12-1, -4 and -5 have gone into alarm. The image processing has produced and the display 32 reflects a second vector V4 which is indicating a fire development going in a direction generally opposite to the vector V3'. As described above, such fire developments on a single floor of region R are indicative of two separate fire conditions which are developing in a direction so as to move toward one another. This information could be especially useful to first responders looking for individuals at the region particularly in the areas associated with detectors 12*c*, 12*f*, 12*i*, 12*j*, 12*k*, 12*l*, where there is as yet no fire involvement.

It will be understood that various types of image processing come within the spirit and scope of the invention. These include vector analysis, neural network processing, or pattern recognition. Other types of processing could also be used.

Those of skill in the art will understand that there are factors other than velocity of the fire, direction of progress of the fire, and the locations of barriers to the spread of the fire that might also influence fire progress in a building. These and other factors could be incorporated with the above described processing of fire progress.

For example, temperature is one factor that may influence fire progress. The higher the temperature around a fire, the more quickly it will burn fuels available to it, and the quicker it will spread.

The character of the space that the fire is in will influence fire spread. Fire will spread more quickly through 100 feet of vertical space than it will through 100 feet of horizontal space.

Fuel influences the spread of fire. The greater the fuel load available in a space, the hotter and possibly faster, a fire will spread.

The air supply can influence the spread of fire. A fire with plentiful air supply, and therefore plentiful oxygen, will bum faster and spread faster than a fire that is starved for air. Also, fires that are starved for air but have built up considerable heat can suddenly and explosively flash over if suddenly given air.

All of the above are exemplary only, and some or all could be incorporated into the above-described processing. Other factors could also be incorporated without departing from the spirit and scope of the invention. Processing software, to take into account some or all of the above factors, executable by processor 36*a*, or by circuits 24, could be stored in circuits 30 or 24 without limitation.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A method of evaluating a developing fire condition in a region being monitored comprising:

establishing a plurality of fire detection points in a region;

collecting indicia from the points indicative of a fire condition;

establishing graphically, a direction of fire travel in response to at least some of the collected indicia;

where fire direction is established by comparing sets of indicia collected during a plurality of time intervals; and which includes displaying a time based sequence of periodically collected indicia and generating a fire velocity indicator in response thereto.

2. A method as in claim 1 which includes displaying a representation of the region and displaying the fire velocity indicating symbol thereon.

3. A method as in claim 1 which includes automatically evaluating an effect on fire direction in response to the presence of a pre-established fire barrier.

4. A method as in claim 3 which includes:

projecting a change in fire direction in response to the fire encountering the fire barner.

5. A method as in claim 3 which includes:

generating a change of direction indicator in response thereto.

6. A method as in claim 5 which includes:

displaying a change of direction indicating symbol on a representation of the region.

7. A method as in claim 2 which includes:

automatically evaluating an effect on fire direction in response to the presence of a pre-established fire barrier.

8. A method as in claim 7 which includes:

displaying a change of direction indicating symbol on a representation of the region.

* * * * *